United States Patent [19]

Li et al.

[11] 4,133,087

[45] * Jan. 9, 1979

[54] METHOD AND APPARATUS FOR TEXTURIZING CONTINUOUS FILAMENTS

[75] Inventors: Hsin L. Li, Parsippany; Hendrikus J. Oswald, Morristown; Alfred L. Liland, Lake Shawnee, all of N.J.

[73] Assignee: Allied Chemical Corporation, Morris Township, Morris County, N.J.

[ * ] Notice: The portion of the term of this patent subsequent to May 24, 1994, has been disclaimed.

[21] Appl. No.: 799,066

[22] Filed: May 20, 1977

Related U.S. Application Data

[63] Continuation-in-part of Ser. No. 619,085, Oct. 2, 1975, Pat. No. 4,024,611.

[51] Int. Cl.[2] ..... D02G 1/20; D02G 1/16; D02G 1/12

[52] U.S. Cl. ..... 28/257; 28/267

[58] Field of Search ..... 28/254, 255, 256, 257, 28/258, 263, 266, 267

[56] References Cited

U.S. PATENT DOCUMENTS

| | | | |
|---|---|---|---|
| 2,734,228 | 2/1956 | Hay | 28/267 |
| 3,156,028 | 11/1964 | Weiss et al. | 28/257 |
| 3,438,101 | 4/1969 | Le Noir et al. | 28/256 |
| 3,859,697 | 1/1975 | Guenther | 28/254 |
| 3,861,133 | 1/1975 | Frankfort et al. | 28/260 |
| 3,899,811 | 8/1975 | Bauch | 28/257 |
| 4,024,610 | 5/1977 | Li et al. | 28/257 |

*Primary Examiner*—Louis Rimrodt
*Attorney, Agent, or Firm*—Ernest D. Buff

[57] ABSTRACT

Continuous filaments are fed by aspiration into a stream of heated fluid. The filaments are then contacted with at least a second stream of heated fluid to increase the temperature of the filaments. The combined streams of fluid containing the filaments are directed into contact with a barrier disposed within a chamber at a force sufficient to initiate crimping of the filaments. A major portion of the fluid is separated from the filaments and expelled from the chamber. The filaments are transported through the chamber by continuous movement of a surface therein at sufficient velocity to cause overfeeding of the filaments, whereby the filaments are forced against a mass thereof producing crimps therein. One or more streams of heated fluid are then contacted with the mass of filaments to set the crimps. The crimped filaments emerge from the chamber through an outlet opening therein.

25 Claims, 6 Drawing Figures

FIG. 4
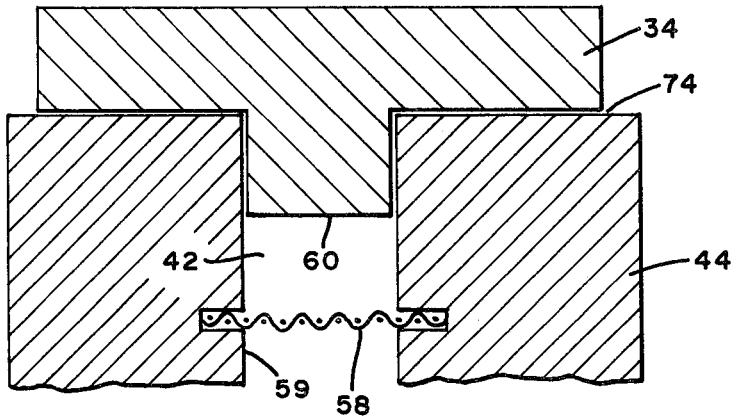
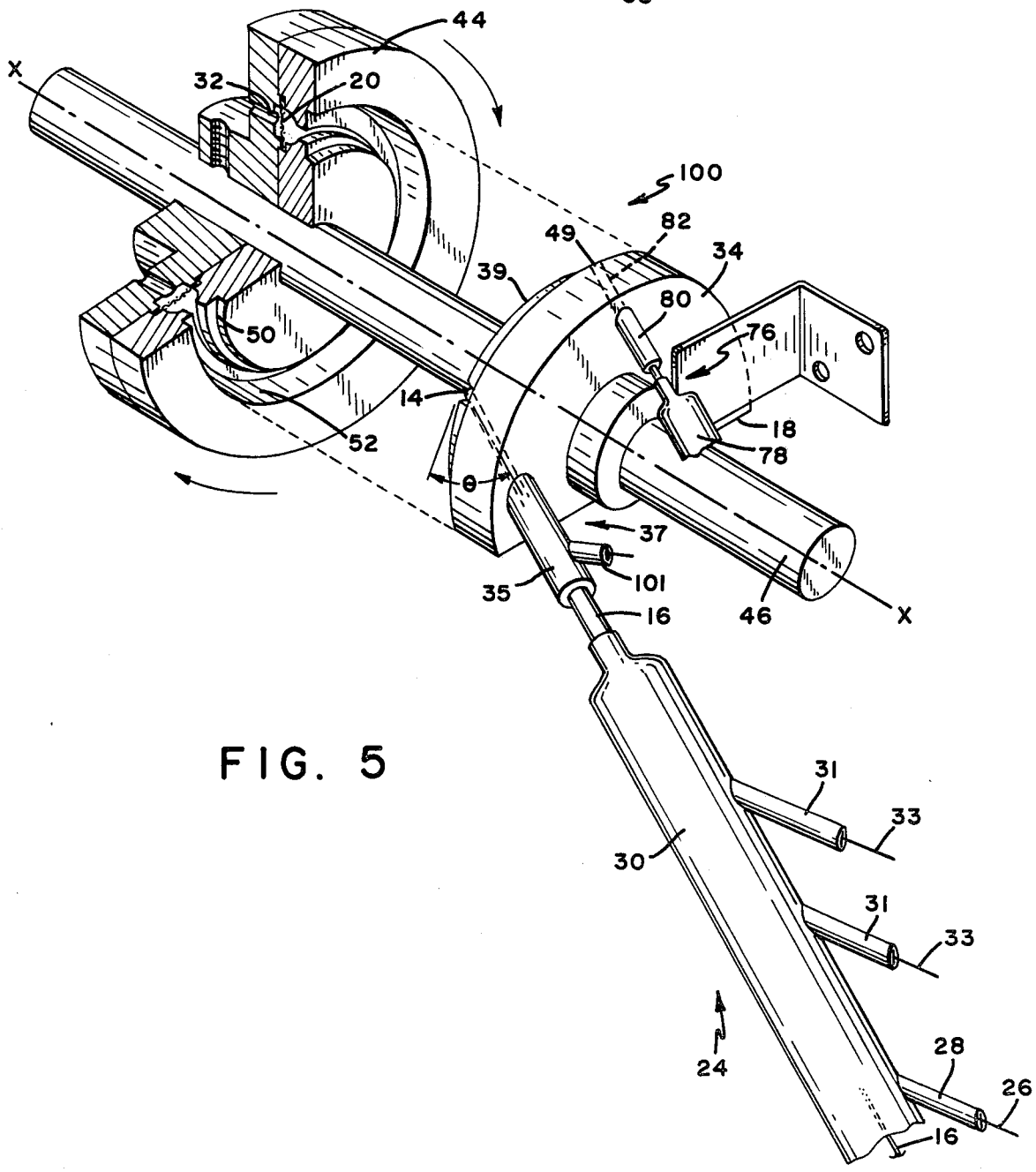
FIG. 5

METHOD AND APPARATUS FOR TEXTURIZING CONTINUOUS FILAMENTS

CROSS-REFERENCE TO RELATED APPLICATIONS

This application is a continuation-in-part to copending application Ser. No. 619,085, filed Oct. 2, 1975, entitled "Method and Apparatus for Texturizing Continuous Filaments", now U.S. Pat. No. 4,024,611 of May 24, 1977.

BACKGROUND OF THE INVENTION

1. Field of the Invention

This invention relates to method and apparatus for preparing crimped fibrous structures and more particularly to means for crimping textile fibrous materials such as filaments, yarn, tow for staple fibers and the like.

2. Description of the Prior Art

In the apparatus conventionally used to crimp textile strands to increase their bulkiness, a tow of continuous filaments is forced by fluid energy against a mass of tow within a chamber, and emerges in crimped form from the chamber when the pressure on the mass exceeds a certain limit. The number of crimps produced by such apparatus per inch of the filaments, as well as the skein shrinkage or crimp contraction level produced in the filaments, is too low for economical processing of the filaments into high quality knitting yarns, fabrics, high stretch yarns and the like. Higher fluid temperatures, as in the order of 400° C., increase crimping levels but decrease orientation of the filaments, reducing their tensile strength and/or dyeing uniformity. Increasing mass flow of the fluid to heat the yarn at lower fluid temperatures produces turbulence within the chamber, destroying incipient crimp and decreasing the skein shrinkage level of the filaments.

SUMMARY OF THE INVENTION

The present invention provides a method and apparatus whereby continuous filaments are crimped at relatively low temperature in an economical and highly reliable manner. The filaments, which may be in the form of yarn, are fed by aspiration into a stream of heated fluid, the temperature of the fluid being, for example about 150° to 350° C. The filaments are then contacted with at least a second stream of heated fluid having a temperature of about 180° to 280° C. to increase the temperature of the filaments and minimize the temperature gradient thereof. The combined streams of fluid and filaments are directed into contact with barrier means disposed within a chamber, the force of contact being sufficient to initiate crimping of the filaments. Upon contact with the barrier means, the major portion of the compressible fluid is separated from the filaments and expelled from the chamber. The filaments are transported through the chamber by continuous movement of a surface therein at sufficient velocity to cause overfeeding of the filaments into the chamber. Due to such overfeeding, the filaments are forced against a mass of the filaments within a zone of compaction in the chamber, producing crimps therein. One or more streams of heated fluid are then contacted with the mass of filaments to set the crimps. The chamber has an inlet opening for receiving the filaments, fluid jet heating means for contacting the mass with heated fluid and fluid escape means for separating the fluid from the filaments and expelling it from the chamber. A carrier means associated with the chamber forms the continuously moving surface.

It has been found that contacting previously heated filaments with at least a second stream of fluid to raise the temperature of the center and exterior surface of each of the filaments in a uniform manner increases the number of crimps per inch of the filaments as well the memory thereof. Further, the flexibility of the filaments is also increased and crimp sharpness is improved. Due to the increased flexibility and crimp sharpness created in the filaments during crimping, the pressure and temperature of the fluids required for crimping are surprisingly low, i.e. about 10 to 500 psig and about 150° to 350° C. Subsequently contacting the mass of filaments with heated fluid to set the crimps therein further increases filament flexibility and crimp sharpness, the number of crimps per inch of the filaments, and the memory thereof, with the result that the crimps are produced in a highly efficient manner. Crimping levels are unusually high, i.e. in excess of 40 crimps per inch and typically as high as 50 crimps per inch or more. Filament degradation is minimized, skein shrinkage level is greatly improved, i.e. in excess of 35 percent, and uniformity and consistency of crimp are easily controlled. Thus the texturized filaments of this invention permit production of high-bulk and stretch knitting yarn at higher speeds and lower temperatures and costs than those incurred by conventional operations wherein the filaments are crimped using a single heating stage.

BRIEF DESCRIPTION OF THE DRAWING

The invention will be more fully understood and further advantages will become apparent when reference is made to the following detailed description and the accompanying drawings in which:

FIG. 4 is a cross-section taken along the line 4—4 of FIG. 3;

FIG. 5 is a perspective view illustrating one form of apparatus for carrying out the method of this invention.

DESCRIPTION OF THE PREFERRED EMBODIMENT

The crimping apparatus of this invention comprises a chamber having inlet, outlet, heating and fluid escape means. Such chamber may be fabricated in a number of diverse sizes and configurations. For illustrative purposes the invention is described in connection with a chamber having an arcuate configuration. It will be readily appreciated, however, that chambers having linear as well as curvilinear configurations fall within the scope of the present invention.

Figure 1:
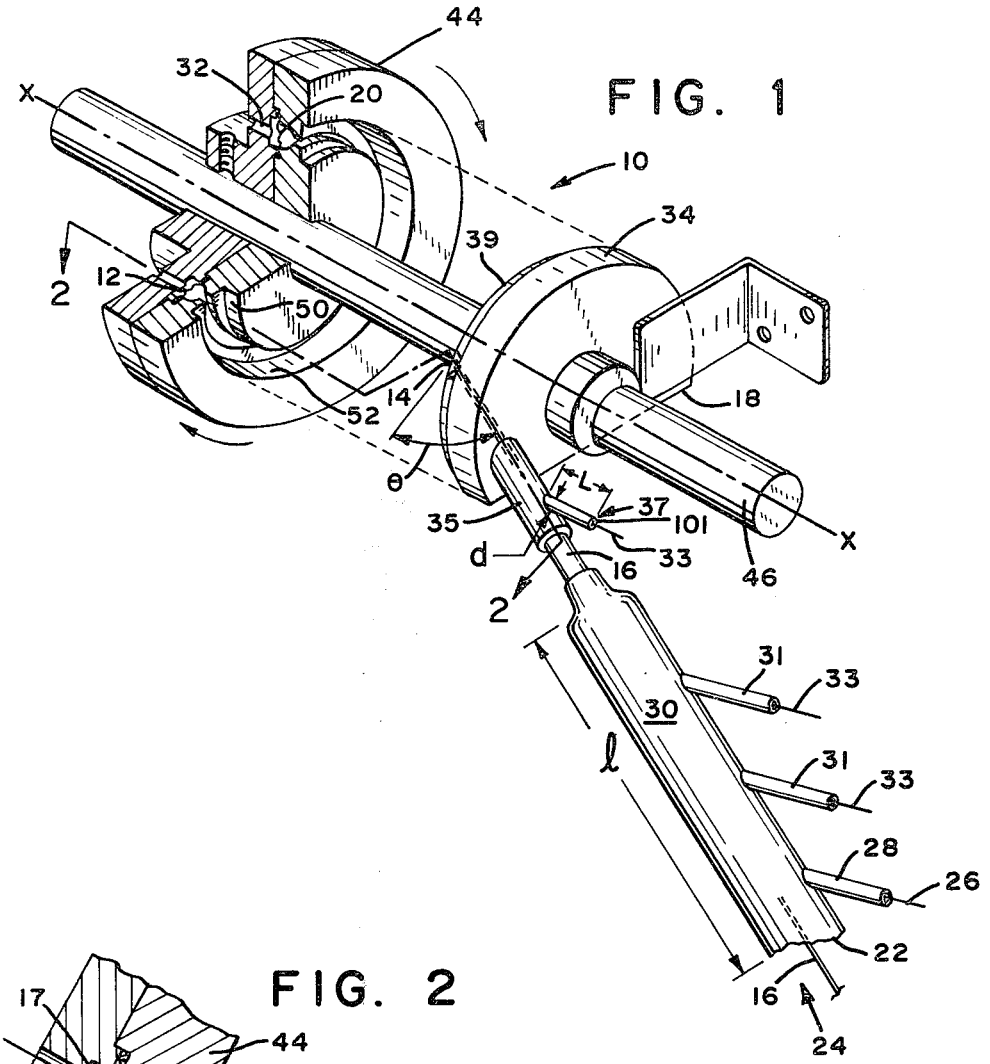
FIG. 1 is a perspective view illustrating one form of apparatus for contacting previously heated filaments with plural streams of heated fluid, the cover and chamber of the apparatus having a disengaged position and the chamber being partially broken away to show the construction thereof.
Figure 2:
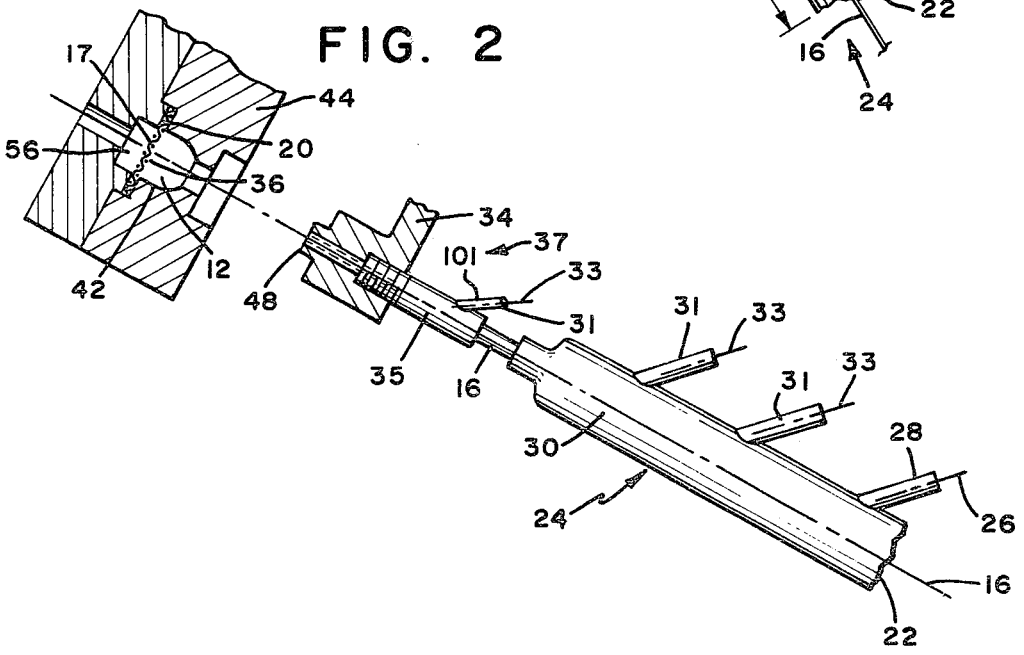
FIG. 2 is a section taken along the line 2—2 of FIG. 1, the cover and chamber of the apparatus having a disengaged position.

Referring to FIGS. 1 and 2 of the drawings, crimping apparatus used to contact previously heated filaments with plural streams of heated fluid is shown generally at 10. The apparatus 10 has a chamber 12 including an inlet opening 14 for receiving the filaments 16 to be crimped and a barrier means 20 which represents a portion of a perforated plate 17, as shown in FIG. 2 and described hereinafter, is disposed within the chamber 12 adjacent inlet opening 14. Continuous filaments 16, preferably in the form of yarn having a temperature of about 15° to 32° C. enter inlet 22 of a heating means, shown generally at 24. Steam or some other heated fluid, such as heated air, nitrogen, carbon dioxide and the like, having a temperature of about 150° to 350° C., preferably about 200° to 330° C., enters fluid inlet 28 and forces filaments 16 along tube 30 of heating means 24. Tube 30 is provided with a second fluid inlet 31 and preferably a plurality of additional fluid inlets for directing at least a second stream of heated fluid, having a temperature of about 150° to 350° C., preferably about 200° to 330° C., into contact with filaments 16 in tube 30 and, optionally, in tube 35 of fluid directing means, shown generally at 37, to increase the temperature of the filaments and minimize the temperature gradient thereof. After contact with streams of fluid 26 and 33, filaments 16 from tube 30 are aspirated into tube 35 of fluid directing means by stream 33 of nozzle 101 and are directed thereby into contact with barrier means 20, the contact having sufficient force to initiate crimping of the filaments 16. Upon contact with barrier means 20, the major portion of the fluid passes through fluid escape means 32 and is thereby separated from the filaments 16 and expelled from the chamber 12. In order to prevent removal of crimp or deformation initiated in the filaments 16 during separation of the fluid therefrom, it is necessary to prevent the filaments from being subjected to tension or drag during the period of their residence in chamber 12. The initially crimped filaments 16 containing incipient crimps are therefore transported through the chamber 12 by a carrier means which comprises a surface 36 formed by screen 17 adapted for movement relative to the chamber 12 at a velocity sufficient to cause overfeeding of the filaments thereinto. Due to such overfeeding the filaments 16 are forced against a mass 38 of the filaments 16 within a zone of compaction 40 (shown in FIG. 3) in the chamber 12 producing crimps therein.

Figure 3:
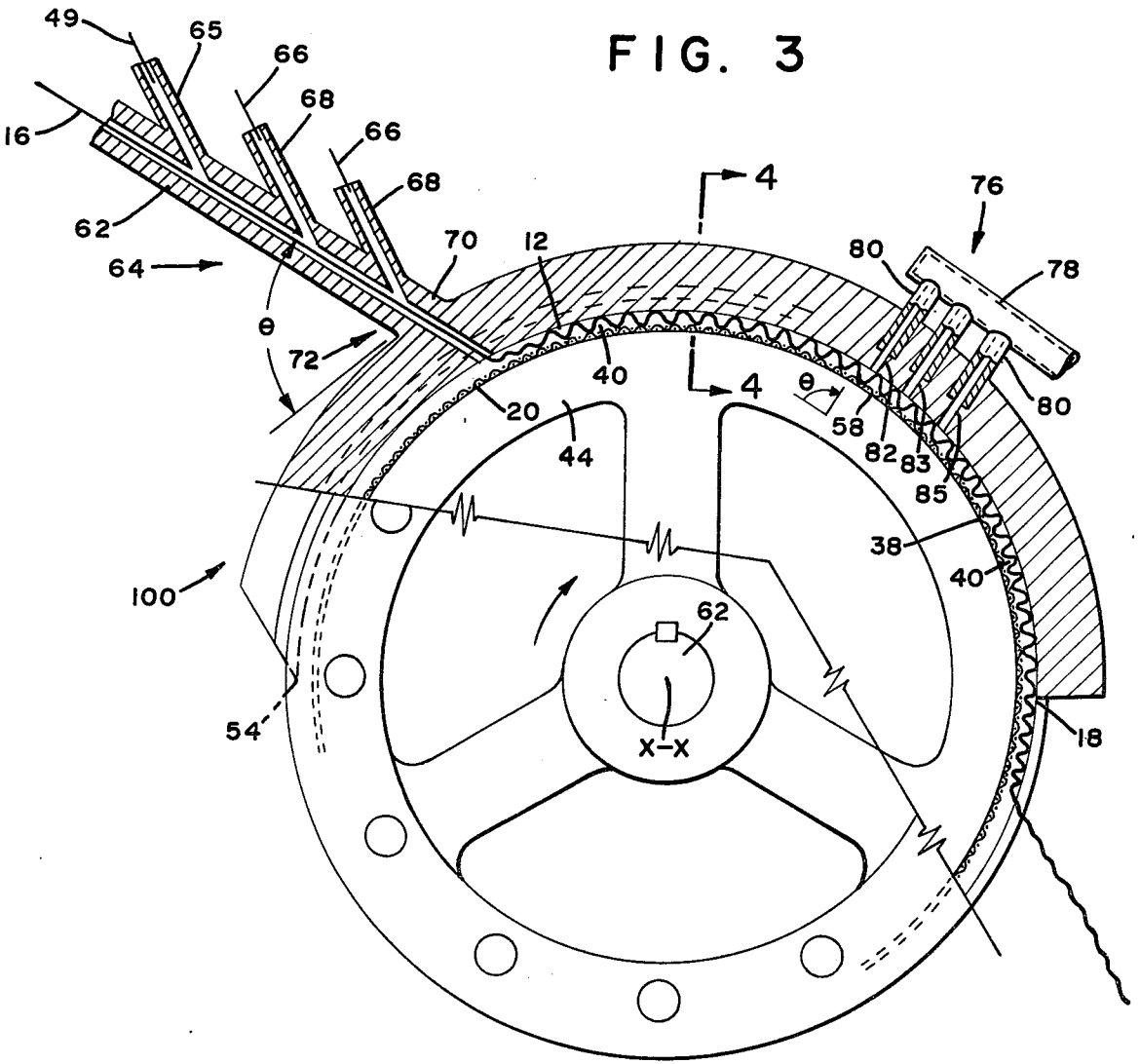
FIG. 3 is a plan view of another form of apparatus for crimping continuous filaments.

As shown in FIGS. 3 and 5, the apparatus 100 is provided with a crimp setting means, generally indicated at 76, including fluid jet heating means 80, disposed in chamber 12 downstream of fluid directing means 37, for contacting the mass 38 of filaments 16 with a stream of heated fluid from heating vessel 78 to set the crimps therein. The crimped filaments emerge through outlet opening 18 of the chamber 12 in final crimped form.

Chamber 12 is defined by peripheral recess 42 (shown in FIG. 2) in drum 44 and opposing wall 39 of cover 34. The drum 44 is mounted on shaft 46 for rotation about axis x-x. Fluid from nozzle 101 and filaments 16, directed through tube 35 into contact with barrier means 20 disposed in chamber 12, is separated from the filaments 15 and expelled from chamber 12 through passageways 56 formed in drum 44. Drum 44 is provided with discharge ports (not shown) extending through the drum and connecting with an annular chamber 56 under recess 42. The annular chamber 56 is separated from the recess 42 by perforated plate or screen 17, which forms the bottom of recess 42 and, together with chamber 56 and the discharge ports, comprises the fluid escape means 32. Screen 17 has a mesh size ranging from about 50 to 400, and preferably from about 90 to 325.

The barrier means 20 comprises a portion of perforated plate 17 adapted to intercept the compressible fluid stream from fluid directing means 37. In the apparatus shown in FIG. 1 of the drawing, the portion of screen 17 which represents barrier means 20 changes continuously as the periphery of drum 44 rotates. Alternatively, the barrier means can comprise a porous or nonporous plate (not shown) alone or in combination with screen 17, the plate being fixedly mounted on the fluid directing means 37 and projecting to a point of interception with streams 26, 33 inside chamber 12 and adjacent to the inlet opening 14 thereof.

Fluid directing means 37 is positioned relative to drum 44 so that the end 48 of tube 35 is in relatively close proximity to barrier means 20. The distance between end 48 and barrier means 20, as well as the cross-sectional area of the end 48 can be varied depending on the velocity and temperature of the filaments and of the fluid stream, the denier of the filaments, the angle at which the stream intersects the barrier means 20, the coefficient of friction of the impacting surface of barrier means 20 and the cross-sectional area of chamber 12. Generally, upon impact with the barrier means 20, fluid stream 33 has a velocity of about 300 to 1500 feet per second and a temperature of about 100° to 280° C. and a total pressure of about 10 to 500 psig; and filaments 16 have a velocity of about 200 to 30,000 feet per minute, a temperature of about 100° to 250° C., and a denier of about 1 to 25 per filament, and a yarn denier of about 15 to 5,000. The coefficient of friction of the impacting surface is about 0.05 to 0.9, the angle of impact, $\theta$, is about 15° to 75°. The distance between end 48 and point of impact of fluid stream 33 on surface 36 is about 0.01 to 0.5 inch, the cross-sectional area of end 48 is about 0.0002 to 0.75 square inch and the cross-sectional area of chamber 12 is about 0.00015 to 1.00 square inch.

Preferably, fluid streams 33 contact the impacting surface of barrier means 20 at a velocity of about 600 to 1500 feet per second, a total pressure of about 20 to 300 psig and a temperature of 180° to 280° C., causing filaments having a denier of about 2 to 15 per filament and a yarn denier of about 21 to 2,600 to contact the impacting surface at a velocity of about 3,000 to 23,000 feet per minute and temperature of about 150° to 220° C. The coefficient of friction of the impacting surface is preferably about 0.1 to 0.6, the angle of impact, $\theta$, is preferably about 30° to 70°, the distance between end 48 and point of impact of fluid stream 33 on surface 36 is preferably about 0.02 inch to 0.30 inch, the cross-sectional area of end 48 is about 0.0006 to 0.40 square inch and the cross-sectional area of chamber 12 is about 0.00075 to 0.40 square inch.

Fluid escape means 32 is located with respect to barrier means 20 so that a major portion of fluid stream 33 contacting barrier means 20 is separated from filaments 16 and expelled from chamber 12. The fluid escape means 32 comprises perforated plate or screen 17, together with exhaust chamber 56 and discharge ports leading to a point exterior of drum 44. The number and diameters of the apertures is sufficient to separate from filaments 16 and expel from chamber 12 a major portion of fluid stream 33 contacting barrier means 20 as in the order of about 60 to 98 percent, and preferably about 70 to 95 percent thereof. The fluid escape means can also comprise a plurality of apertures provided in cover 34.

Referring again to FIGS. 1 and 2, filaments 16 entering compaction zone 40 (shown in FIG. 3) impinge against previously advanced filaments (mass 38 of filaments 16) which has not been withdrawn due to the greater feed rate of filaments 16 into zone 40 in comparison to the rate at which the filaments are removed from the zone. As a result of this overfeed further crimp is imparted to the filaments 16.

After impinging against the mass 38 of filaments 16, the crimped filaments move in recess 42 for about one-fourth to three-fourths of a rotation of drum 44 during which time they are contacted with a stream of heated fluid from heating vessel 78 (shown in FIG. 5) to set the crimps. Thereafter, the filaments are moved to outlet opening 18 where they are taken up on conventional bobbins using conventional winders and the like. Rear extension block 54 connected to cover 34 by rivets (not shown), adhesive or the like, prevents filaments 16 or plugs thereof, which are inadvertently broken during residence in chamber 12 from re-entering the chamber 12.

The crimp setting means can comprise a fluid jet heating means 80, including at least one passageway 82, and preferably several passageways 82, 83, 85, disposed in cover 34 for communication with chamber 12 downstream of inlet opening 14. Heat of fluid entering vessel 78 travels through passageway 82 into chamber 12 in the form of a stream. The passageway 82 is positioned in cover 34 so that the stream of heated fluid enters the compaction zone 40 contacting the mass 38 of filaments 16 and setting the crimps therein. The temperature, volume, velocity and pressure of the stream of fluid from vessel 78 can vary depending on the denier of the filaments, the cross-sectional area of chamber 12, the rotational velocity of drum 44 and the angle at which the stream intersects the mass 38 of filaments 16. For relatively high speed yarn production, the cross-sectional area of the end 49 of the passageway 82 of the fluid jet heating means 80 should be about 0.0001 to 0.04 square inch, and preferably about 0.0006 to 0.03 square inch. Generally, upon contact with the mass 38 of filaments 16, the stream of fluid has a velocity of about 500 to 1500 feet per second and a temperature of about 150° to 350° C. and a total pressure of about 5 to 500 psig.; mass 38 has a velocity of about 10 to 5,000 feet per minute, a temperature of about 100° to 220° C., a denier of about 1 to 25 per filament, and a yarn denier of about 15 to 5,000; the cross-sectional area of chamber 12 is about 0.00015 to 1.00 square inch. Preferably, fluid from vessel 78 contacts the mass 38 of filaments 16 at a velocity of about 600 to 1500 feet per second, a total pressure of about 10 to 300 psig. and a temperature of about 170° to 330° C., setting the crimps in filaments having a denier of about 2 to 15 per filament and a yarn denier of about 21 to 2,600. The angle of impact, $\phi$, between the stream of fluid from vessel 78 and mass 38 is preferably about 45° to 135°, and the cross-sectional area of chamber 12 is about 0.00075 to 0.40 square inch.

In the embodiment shown in FIGS. 1, 2 and 5 the carrier means for transporting filaments 16 through chamber 12 is a surface including walls 50, 52 and perforated plate 17 of recess 42. The carrier means can alternatively be comprised of perforated plate 17 solely. Carrier velocity varies inversely with the surface area thereof and the crimp frequency desired. Generally the velocity of the carrier means shown in FIGS. 1, 2 and 5 is about 0.1 to 10 percent of the velocity of filaments 16. By varying the velocity of the carrier means, the residence time of filaments 16 in compaction zone 40 is controlled to produce uniformity of crimp and degree of set in the filaments 16 over a wide range of crimp level.

The apparatus 100 which has been disclosed herein can be modified in numerous ways without departing from the scope of the invention. As previously noted, the configuration of chamber 12 can be linear or curvilinear. Barrier means 20 can be porous or nonporous and can comprise a stationary noncontinuous or movable continuous impacting surface. Each of peripheral recess 42 of drum 44 and cover 34 can be perforated to provide for escape of compressible fluid through all sides of chamber 12. The length, 1, of tube 30 can be varied to alter the residence time of filaments 16 there in. Generally, the heating means 24 includes a tube 30 having a length of about 3 to 60 inches; fluid inlets 28, 31 are spaced longitudinally of tube 30 by a center to center distance of about 1 to 10 inches; the cross-sectional areas of the fluid inlets 28, 31 are about 0.00008 to 0.03 square inch; and the number of fluid inlets 28, 33 is about 1 to 60. Preferably, tube 30 of heating means 24 has a length, 1, of about 6 to 42 inches; fluid inlets 28, 31 are spaced longitudinally of tube 30 by a center to center distance of about 2 to 5 inches; the cross-sectional areas of the fluid inlets 28, 31 are about 0.0003 to 0.020 square inch; the number of fluid inlets 28, 31 are about 2 to 10. The fluid of which streams 26, 33 are comprised can be either compressible or incompressible. Compressible fluids which are suitable include air, steam, nitrogen, argon, gas mixtures and the like. Incompressible fluids which are suitable include water, saturated steam, mixtures of liquids and the like. The heating means can, alternatively, comprise a stationary heating block(s), a rotating heating roll(s) heated electrically or by high temperature fluids, or one or more infrared, induction or microwave heaters, or a combination thereof.

As shown in FIGS. 3 and 4, barrier means 20 can be a screen 58 forming a wall of recess 42 in drum 44 opposite wall 60 of cover 34. The drum 44 is mounted on shaft 62 which rotates on bearings (not shown) about axis x—x. Filaments 16 enter tube 62 of a heating means (shown generally at 64). A first stream of heated fluid 49 enters tube 62 through fluid inlet 65 forcing filaments 16 along the tube 62. At least a second stream of heated fluid 66 enters tube 62 through fluid inlets 68 contacting filaments 16 and increasing the temperature thereof. The combined streams of fluid 49, 66 and filaments 16 enter tube 70 of fluid directing means, shown generally at 72. The latter directs the filaments 16 into contact with barrier means 20 disposed in chamber 12 in the manner set forth in connection with FIGS. 1 and 2. Fluid 49, 66 is separated from filaments 16 and expelled from chamber 12 through discharge ports (not shown) connected with passageway 59 of drum 44, as well as through passageway 74 formed between drum 44 and cover 34. A major portion of the fluid 49, 66 can, optionally, be expelled from tube 62 of heating means 64 prior to entering tube 70 of fluid directing means 72, and from chamber 12 through screen 58. The filaments 16 are contacted with one or more streams of heated fluid from vessel 78 (FIGS. 3 and 5) and emerge from chamber 12 through an outlet opening 18 in the manner set forth above in connection with FIGS. 1, 2 and 5.

In operation, yarn in the form of continuous filaments 16 is fed by aspiration into a stream of fluid 26. The filaments are thereafter contacted with at least a second stream 33 of fluid to increase the temperature thereof in a uniform manner. Fluid directing means 37 directs the stream of fluid 26, 33 containing filaments 16 into contact with barrier means 20, disposed within chamber 12, to initiate crimping of the filaments 16. Fluid escape means 32 separates the major portion of the fluid from the filaments 16 and expels it from chamber 12. A carrier means transports the filaments 16 through chamber 12 to cause overfeeding of the filaments 16 into the chamber. One or more streams of heated fluid are directed by fluid jet heating means 80 into contact with the mass 38 of filaments 16 to set the crimps. The filaments emerge from the chamber 12 in crimped form and are wound onto packages.

Figure 6:
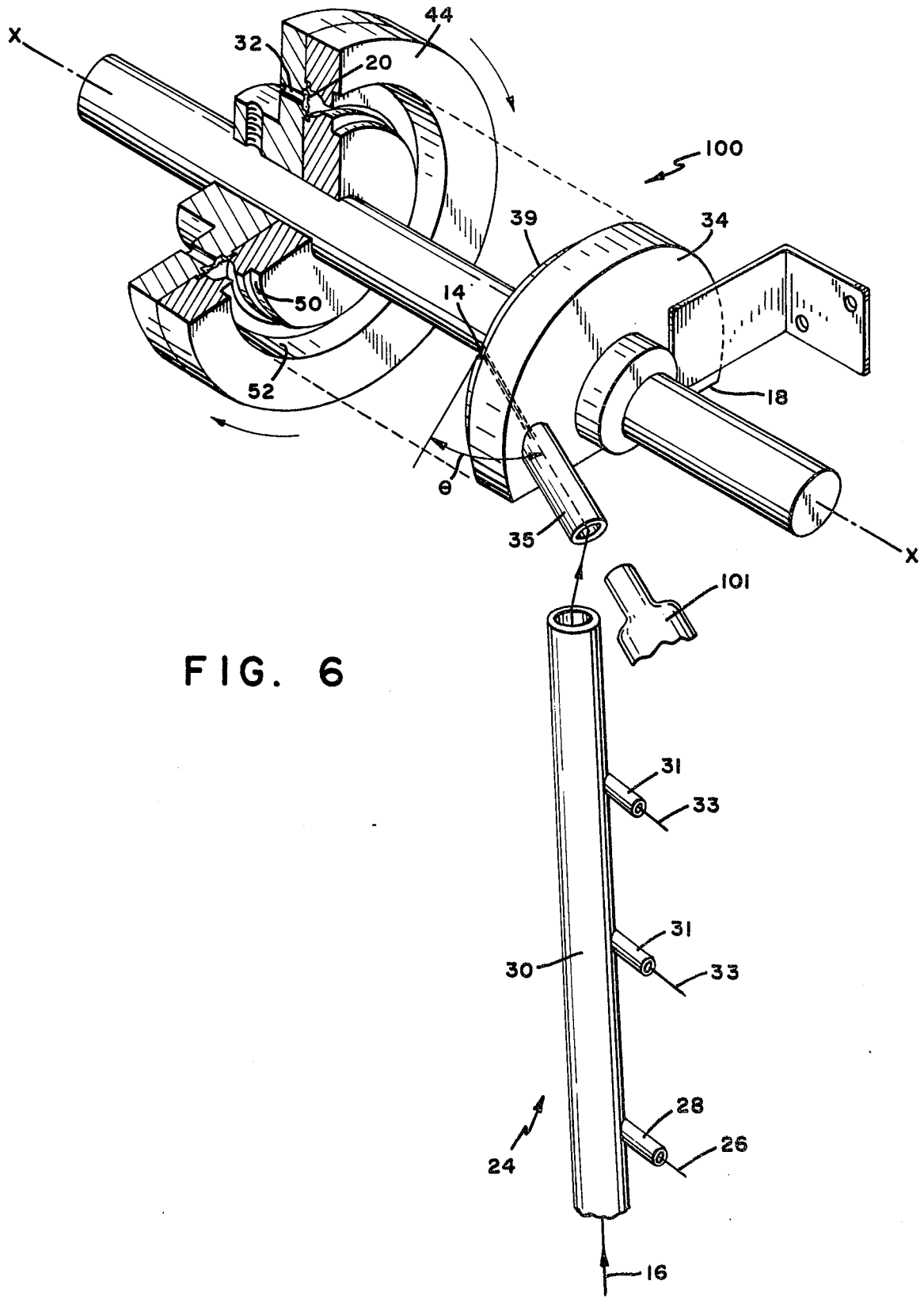
FIG. 6 is a perspective view illustrating another embodiment of the apparatus of FIG. 1.

As shown in FIG. 6, tube 30 can be angularly positioned relative to tube 35 to facilitate separation of fluid from the filaments 16, the latter being directed into tube 35 by heated fluid from nozzle 101. These and other modifications are intended to fall within the scope of the invention as defined by the subjoined claims.

While the method and apparatus of this invention have been described herein primarily in terms of texturizing thermoplastic filaments, especially polyester filaments, it is clear that the method and apparatus of the present invention can also be used to crimp a wide variety of other filaments, such as filaments composed of homopolymers and copolymers of the following materials: ϵ-aminocaproic acid, hexamethylene adipamide, ethylene terephthalate, tetramethylene terephthalate, 1,4-cyclohexylenedimethylene terephthalate and blends thereof. In addition, the filaments 16 can be composed of polyacrylonitrile, polypropylene, poly-4-aminobutyric acid, cellulose acetate and blends thereof.

The following examples are presented in order to provide a more complete understanding of the invention. The specific techniques, conditions, materials and reported data set forth to illustrate the principles and practice of the invention are exemplary and should not be construed as limiting the scope of the invention.

EXAMPLE 1

Polyethylene terephthalate chips having a number average molecular weight of 25,000 were melt spun using a screw type extruder in which the barrel and dye temperatures were maintained at 270° C. and 280° C., respectively. The spinnerette used had 34 holes, each hole having a capillary diameter of 0.010 inch and a length of 0.010 inch. An air quenched system was used to solidify the filaments. The yarn was a 255 denier, 34 filament, zero twist, partially oriented yarn having a round cross-section. The yarn was coated with approximately 0.25% by weight of a textile finish agent and drawn using a draw ratio of 1.9. The drawing process consisted of passing 10 wraps of the yarn around (1) a pair of heated rolls maintained at a temperature of 75° C., (2) a stationary block heater 6 inches long having a temperature of 180° C., and (3) a pair of draw rolls having a temperature of 175° C. The final draw denier was 134. Drawing speed was 4500 feet per minute.

The yarn was textured using the apparatus shown generally in FIGS. 3 and 5. Nozzle 101 had a diameter, d, of 0.062 inch and a length, l, of 0.125 inch. Superheated steam at 325° C. and 100 psig was supplied into nozzle 101 through conduit means (not shown). Heating means 24 included (1) a tube 30 having a length of 20 inches, an average inside diameter of 0.080 inch and an outside diameter of 0.150 inch, and (2) a fluid inlet having an inside diameter of 0.036 inch. Steam under pressure of 80 psig flowed through the fluid inlet into tube 30 forcing filaments 16 therethrough. The filaments then entered energy tube 35 and were carried at 8300 feet per minute therethrough and into contact with barrier means 20. Energy tube 35 had an inside diameter of 0.101 inch, and was 5 inches long. The yarn was heated to a temperature of about 160° C. during residence in energy tube 35 and impinged against barrier means 20 at an impact angle, , of 60°. The barrier means 20 was a perforated brass plate 17, 10 inches in diameter and spaced 0.030 inch from the exit orifice 48 of energy tube 35. The perforated brass plate 17 had a thickness of 0.013 inch, a hole-diameter of 0.012 inch and a center-to-center distance between adjacent holes of 0.016 inch, providing the plate with 42% open area. Chamber 12 had a width of 0.200 inch and a depth of 0.030 inch. Chamber 12 was rotated at 25 rpm to provide plate 17 with a surface speed of 65.4 feet per minute. Contact between the yarn containing stream and the plate 17 initiated crimping of the filaments 16. Perforated plate 17 transported the yarn to a zone of compaction 40 wherein a textured plug was formed causing further crimping of the filaments 16. The packing density of the textured plug was calculated to be 33% and the residence time of the plug in chamber 12 was 0.91 seconds. Fluid jet heating means 80 included 5 passageways disposed in cover 34 in communication with chamber 12. Each of the passageways had an internal diameter of 0.027 inches. The passageways were equally spaced 1.5 inch apart circumferentially of cover 34 commencing 5.5 inches downstream of the end of fluid directing means 24. Steam supplied to the passageways by vessel 78 contacted mass 38 of filaments 16 at a pressure of 18 psig and a temperature of 138° C.

The yarn emerged in crimped form from the chamber through outlet opening 18 and was taken up onto conventional parallel wound packages rotated on conventional winders by means of a pair of rollers (not shown). The speed of the winder was approximately 6850 feet per minute.

The average skein shrinkage level of the textured yarn was then determined. The skein shrinkage test consisted of winding the textured yarn into a skein and hanging the skein under no load in a hot air oven at 145° C. for 5 minutes. The skein was removed from the oven and cooled, and a 0.0016 gram per denier weight was hung on it. The new skein length was measured ($L_f$). The percent of skein shrinkage was then calculated from the initial skein length ($L_o$) and the final skein length ($L_f$) in accordance with the equation $(L_o-L_f)/L_o$. Photomicrographs made of 20 filaments selected at random from the textured yarn showed a crimp count of about 40 crimps per inch. The developed skein had an average skein shrinkage level of 36 percent, indicating that the texture yarn was suitable for use in manufacture of wearing apparel.

The textured yarn produced in accordance with Example 1 was knitted on a Lawson-Hemphill Fiber Analysis Knitter having a 54 gauge head 220 needles, a diameter of 3.5 inches and 36 inches per course. The knitted fabric, when dyed, showed good uniformity and was free from streaks. In addition, the fabric had a soft texture, dimensional stability and pleasing appearance.

Having thus described the invention in rather full detail, it will be understood that these details need not be strictly adhered to but that various changes and modifications may suggest themselves to one skilled in the art. It is accordingly intended that all matter con-tained in the above description and shown in the accompanying drawings shall be interpreted as illustrative and not in a limiting sense. strictly adhered to but that various changes and modifications may suggest themselves to one skilled in the art. It is accordingly intended that all matter contained in the above description and shown in the accompanying drawings shall be interpreted as illustrative and not in a limiting sense.

What is claimed is:

1. Apparatus for crimping continuous filaments comprising:

(a) a chamber having an inlet opening for receiving the filaments and an outlet opening for withdrawing the filaments;

(b) barrier means disposed in said chamber adjacent said inlet opening;

(c) fluid directing means for directing a stream of compressible fluid containing said filaments into contact with said barrier means to initiate crimping thereof;

(d) fluid escape means associated with said chamber for separating the major portion of said fluid from said filaments and expelling it from said chamber;

(e) carrier means for transporting said filaments through said chamber, including a continuously moving surface associated with said chamber to cause overfeeding of said filaments into said chamber, said filaments being forced against a mass thereof within said chamber to produce crimps therein;

(f) heating means connected to and upstream of said fluid directing means for contacting said filaments with heated fluid to increase the temperature of the filaments; and (g) crimp setting means, including fluid jet heating means disposed in said chamber downstream of said fluid directing means, for contacting said mass of filaments with at least a second stream of heated fluid to set the crimps, whereby said filaments emerge from the chamber in crimped form.

2. Apparatus as recited in claim 1, wherein said chamber has a curvilinear configuration.

3. Apparatus as recited in claim 1, wherein said barrier means has a coefficient of friction of about 0.05 to 0.9.

4. Apparatus as recited in claim 1, wherein said fluid escape means is a screen having a mesh size ranging from about 50 to 400.

5. Apparatus as recited in claim 1, wherein said heating means includes a tube having at least one fluid inlet therein.

6. Apparatus as recited in claim 5, wherein said tube has a length of about 3 to 60 inches.

7. Apparatus as recited in claim 6, wherein the number of fluid inlets is about 1 to 60.

8. Apparatus as recited in claim 1, wherein said fluid directing means comprises a tube having an end located in relatively close proximity to said barrier means, the cross-sectional area of said end being about 0.0002 to 0.30 square inch and the cross-sectional area of said chamber being about 0.00015 to 1.00 square inch.

9. Apparatus as recited in claim 1, wherein said fluid escape means is a plate containing a plurality of apertures, the number of apertures being sufficient to separate from said filaments and expel from said chamber about 60 to 98 percent of said fluid.

10. Apparatus as recited in claim 1, wherein said chamber has a cover and said fluid jet heating means includes at least one passageway disposed in said cover.

11. Apparatus as recited in claim 10, wherein said passageway has an end in communication with said chamber and the center-to-center distance between said end and said inlet opening is about 0.5 to 30 inches.

12. Apparatus as recited in claim 11, wherein said fluid jet means includes a plurality of passageways.

13. Apparatus as recited in claim 11, wherein the cross-sectional area of said passageway end is about 0.0001 to 0.040 square inch.

14. Apparatus as recited in claim 1, wherein said barrier means is a stationary, noncontinuous impacting surface.

15. A method of crimping continuous filaments, comprising the steps of:

(a) feeding said filaments by aspiration into a stream of heated fluid;

(b) contacting said filaments with at least a second stream of heated fluid to increase the temperature of the filaments;

(c) directing said stream containing said filaments into contact with barrier means disposed within a chamber, the contact having sufficient force to initiate crimping of said filaments;

(d) separating a major portion of said first and second streams of heated fluid from said filaments and expelling it from said chamber;

(e) transporting said filaments through said chamber by continuous movement of a surface therein at sufficient velocity to cause overfeeding of said filaments into said chamber, said filaments being forced against a mass thereof within said chamber to produce crimps therein;

(f) contacting said mass with one or more streams of heated fluid to set the crimps; and (g) removing said filaments in crimped form from said chamber.

16. A method as recited in claim 15, wherein said filaments contact said barrier means at an angle of impact of about 15° to 75°.

17. A method as recited in claim 16, wherein said filaments are composed of material selected from the group consisting of poly 1,4-cyclohexylenedimethylene terephthalate, polyethylene terephthalate, polyhexamethylene adipamide, poly -aminocaproic acid, polypropylene cellulose acetate, cellulose tri-acetate and blends thereof.

18. A method as recited in claim 15, wherein said filaments contact said barrier means at a velocity of about 3000 to 23,000 feet per minute.

19. A method as recited in claim 15, wherein said streams of fluid are compressible.

20. A method as recited in claim 15, wherein the number of streams of fluid contacting said filaments is about 1 to 60.

21. A method as recited in claim 15, wherein the mass is contacted with a plurality of streams of fluid.

22. A method as recited in claim 15, wherein each of said streams of fluid has a temperature of about 150° to 300° C.

23. A method as recited in claim 15, wherein said filaments are composed of polyester.

24. A method as recited in claim 15, wherein said filaments contain in excess of 40 crimps per inch and a skein shrinkage level of at least about 35 percent when removed from said chamber.

25. A method as recited in claim 15, wherein said filaments are composed of nylon.

* * * * *